US005307863A

United States Patent [19]

Kubota et al.

[11] Patent Number: 5,307,863

[45] Date of Patent: May 3, 1994

[54] METHOD FOR CONTINUOUS CASTING OF SLAB

[75] Inventors: Jun Kubota; Akira Shirayama; Toshio Masaoka; Kazutaka Okimoto; Takashi Mori, all of Kawasaki, Japan

[73] Assignee: NKK Corporation, Tokyo, Japan

[21] Appl. No.: 113,958

[22] Filed: Aug. 30, 1993

Related U.S. Application Data

[63] Continuation of Ser. No. 816,608, Dec. 31, 1991, abandoned.

[51] Int. Cl.[5] ..... B22D 27/02

[52] U.S. Cl. ..... 164/466; 164/468

[58] Field of Search ..... 164/466, 468, 502, 504

[56] References Cited

U.S. PATENT DOCUMENTS 4,495,984 1/1985 Kollberg ..... 164/468

4,986,340 1/1991 Eriksson ..... 164/504

FOREIGN PATENT DOCUMENTS 64-10305 2/1989 Japan .

*Primary Examiner*—Kuang Y. Lin

*Attorney, Agent, or Firm*—Frishauf, Holtz, Goodman & Woodward

[57] ABSTRACT

A method for continuous casting of a slab comprises feeding molten steel into a mold through exit ports of an immersion nozzle and controlling a stream of the molten steel by means of an electromagnetic stirrer having a linearly shifting magnetic field. The direction of the linearly shifting magnetic field is toward the immersion nozzle, which is positioned at the center of the mold from a pair of narrow sides of the mold. A first frequency control step controls a frequency of a wave of the shifting magnetic field to be higher than a threshold frequency, wherein the wave has a period equal to the time during which the stream of the molten steel poured from the immersion nozzle passes through an area to which the linearly shifting magnetic field is introduced, said area having an upper limit and a lower limit. A second control step controls the frequency of the wave of the linearly shifting magnetic field to be low enough such that the magnetic fluxes of the linearly shifting magnetic field are of a density high enough to apply a braking force to the molten steel.

11 Claims, 11 Drawing Sheets

METHOD FOR CONTINUOUS CASTING OF SLAB

This application is a continuation of application Ser. No. 07/816,608, filed Dec. 31, 1991, now abandoned.

BACKGROUND OF THE INVENTION

1. Field of the Industrial Application

The present invention relates to a method for continuous casting of a steel slab, and more particularly to a method for continuous casting of a slab wherein a wave of a molten steel surface is depressed by introducing an electro magnetic force to the molten steel in a mold.

2. Description of the Related Art

Molten steel is usually poured from a tundish into a mold through an immersion nozzle to prevent the molten steel from being oxidized. The immersion nozzle prevents the molten steel from being exposed to the air. The immersion nozzle for continuous casting of a slab has a pair of exit ports having openings at its lower end. Molten steel is poured into a mold through the exit ports of the immersion nozzle positioned at the center of the mold toward the circumference inside the mold.

It has been an object in recent years in the field of continuous casting of steel to increase casting speed, namely, the speed of pouring molten steel into a mold for increasing a productivity of a continuous casting machine. However, when the casting speed is increased to more than 1.5 m/min, molten steel in the mold is violently disturbed. Various waves of the molten steel of wavelengths from several meters down to several centimeters are generated on the surface of the molten steel, with a portion of the immersion nozzle being fulcrum, whereby the wave height of the molten steel becomes large. Mold powder is also entangled in the molten steel by such a wave of the molten steel surface. The mold powder entangled in the molten steel and non-metallic inclusions produced during a refining process are prevented from rising up to the surface or the molten steel by the violent disturbance of the molten steel in the mold. As a result, those inclusions are hard to remove from the molten steel in the mold. The inclusions entangled in a slab will appear as surface defects and inner defects of a product that has passed through a final processing. Those surface defects and inner defects of a product greatly the lower quality of the product.

As a prior art to prevent such inclusions from being entangled in a slab, a method for electromagnetically stirring molten steel in a mold, which is disclosed in Japanese Examined Patent Publication No. 10305/89, can be pointed out. In the prior art, an electromagnetic stirrer is placed near the meniscus on a wide side of a mold in a continuous casting apparatus. An electromagnetic inducing force is applied to the molten steel in such a direction so as to force back the molten steel along a direction of a width of the mold from a narrow side of the mold toward the immersion nozzle by means of the electromagnetic stirrer. A flow speed of the molten steel poured into the mold from the immersion nozzle is decreased. Owing to the decrease of the flow speed, the wave motion of the molten steel surface in the mold is decreased and a disturbance of the molten steel therein is depressed.

The magnetic field generator used in the prior art is of a linearly shifting magnetic field type. Therefore, an appropriate value and a frequency of electric current should be determined. The frequency has been determined as follows:

The Lorentz force acting on a poured stream of the molten steel should be enhanced to elevate the damping ratio of the flow speed of the poured molten steel. To enhance the Lorentz force, a relative speed of the poured stream of molten steel to a magnetic flux from the narrow side of the mold toward the immersion nozzle should be increased. Accordingly, a shifting speed of the magnetic flux, that is, a frequency of the magnetic flux should be increased. However, when the frequency of the magnetic flux is increased, the magnetic permeability of stainless steel and mold copper plate composing a frame of the mold is lowered, and the magnetic permability of the molten steel is also lowered. As a result, the density of the magnetic flux acting effectively on the poured stream of the molten steel from the immersion nozzle is decreased. A frequency of 0.5 Hz has customarily been used as the appropriate frequency satisfying a condition of both Lorentz force and the magnetic permeability.

FIG. 1 is a graphical representation showing the magnitude of a wave of a molten steel surface in a mold, when the value of electric current in a magnetic field generator is varied under the condition of electric current frequency of 0.5 Hz in the magnetic field generator. The direction of shift of a magnetic field is the direction from the narrow side of the mold toward the immersion nozzle. The magnitude of the wave is represented with an average value of the amplitude of wave of a the molten steel surface, which are obtained by measuring the amplitude of the wave of the molten steel for ten minutes, at positions 40 mm away from the narrow side of the mold and 40 mm away from the wide side of the mold. As shown in FIG. 2, the wave motions are substantially composed of a short period wave 30 having a period of about 1 to 2 seconds and a long period wave 31 having a period of about 10 to 15 seconds. The amplitude of the wave of the molten steel is a wave height difference 32 between two wave heights. One is a wave height showing the maximum height of the short period wave at a moment closest to a moment when the long period wave shows the maximum height, and the other is a height of wave showing the minimum height of the short period wave at a moment when the long period wave shows the minimum height. Lines A, B, C and D in FIG. 1 were carried out under the following conditions.

In line A, a mold had a width of 850 mm. An immersion nozzle had square openings each directed downwardly at 35° relative to a horizontal line. A casting speed of molten steel was 1.6 m/min. In line B, a mold had a width of 1050 mm. An immersion nozzle had square openings each directed downwardly at 35° relative to a horizontal line. A casting speed of molten steel was 1.8 m/min. In line C, a mold had a width of 1250 mm. An immersion nozzle had square openings each directed downwardly at 45° relative to a horizontal line. A casting speed of molten steel was 2.3 m/min. In line D, a mold had a width of 1350 mm. An immersion nozzle had square openings each directed downwardly at 45° relative to a horizontal line.

A casting speed of molten steel was 2.0 m/min. In any of the cases of the lines A, B, C and D, a frequency in a magnetic field generator was 0.5 Hz.

Under the conditions of A and B that the casting speed of molten steel is comparatively small and the width of the mold is small, as electric current in the magnetic field generator is increased, the effect of depressing the wave of the molten steel surface increases.

But, under the conditions of C and D that the casting speed of molten steel is comparatively large and the width of the mold is large, when electric current in the magnetic field generator is excessively increased, the effect of depressing the wave of the molten steel decreases, which promotes the increase of the wave motions, contrary the goals of the technique.

SUMMARY OF THE INVENTION

It is an object of the present invention to provide a method for continuous casting of a slab wherein a wave of molten steel in a mold can be depressed under a flexible control condition of operation.

To attain the above-mentioned object, the present invention provides a method for continuous casting of a slab, comprising the steps of:

feeding molten steel into a mold through exit ports of an immersion nozzle, the mold having a pair of wide sides and a pair of narrow sides, and the immersion nozzle being positioned at the center of the mold from the pair of narrow sides;

controlling a stream of the molten steel by use of an electromagnetic stirrer having a linearly shifting magnetic field, a direction of the linearly shifting magnetic field being toward the immersion nozzle and distributions of magnetic fluxes of said linearly shifting magnetic field being symmetrical with respect to a center line of the immersion nozzle;

a first control step of controlling a frequency of said shifting magnetic flux to be higher frequency than a specific frequency with which the cycle time of the shifting magnetic flux of said shifting magnetic field is equal to the travelling time of said molten steel stream within said shifting magnetic field;

a second control step of controlling a frequency of said shifting magnetic flux to be a lower frequency with which the flux density of said shifting magnetic field in the mold cavity is strong enough to interact with said molten steel stream to give a braking effect to said molten steel stream.

The above objects and other objects and advantages of the present invention will become apparent from the following detailed description, taken in conjunction with the appended drawings.

DESCRIPTION OF PREFERRED EMBODIMENT

Figure 1:
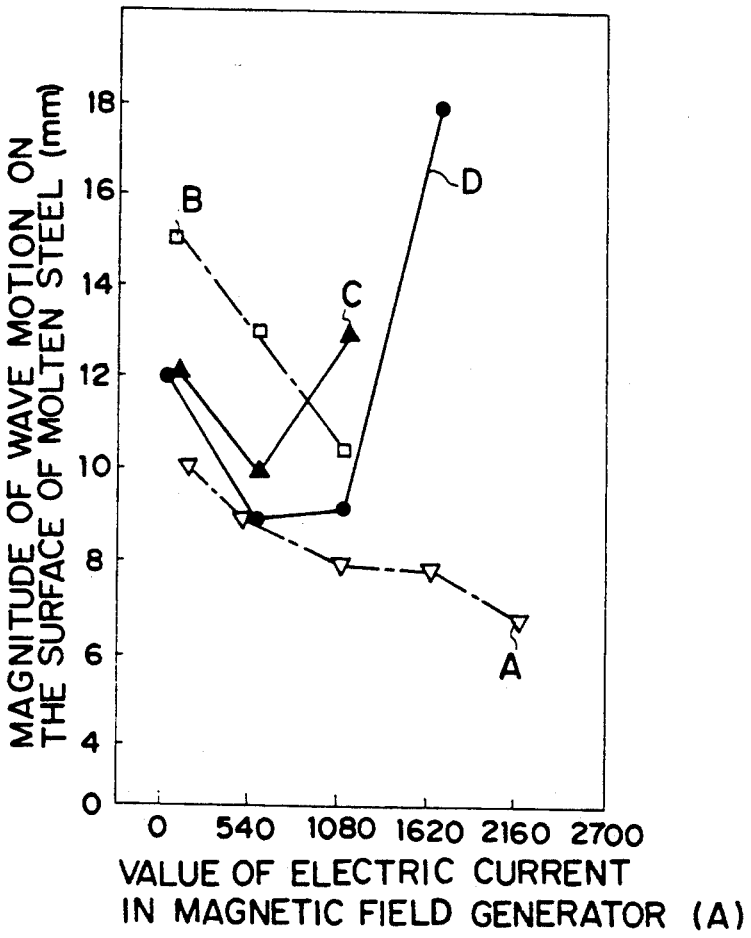
FIG. 1 is a graphical representation showing a magnitude of a wave of a molten steel surface adjacent to the narrow side of a mold when a frequency of electric current in a magnetic field generator is 0.5 Hz.
Figure 2:
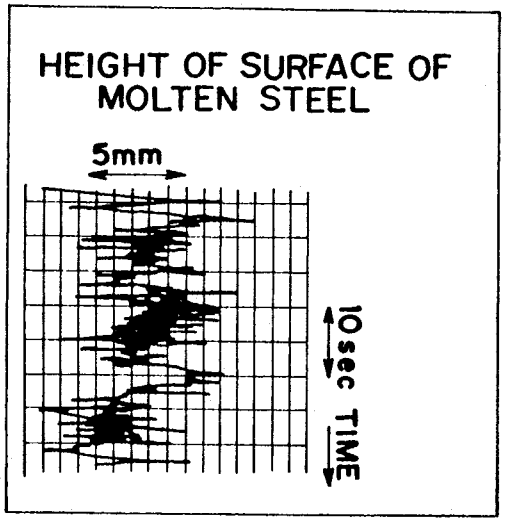
FIG. 2 (A) and (B) are graphical representations explaining the definition of an amplitude of the wave of the molten steel surface.
Figure 2:
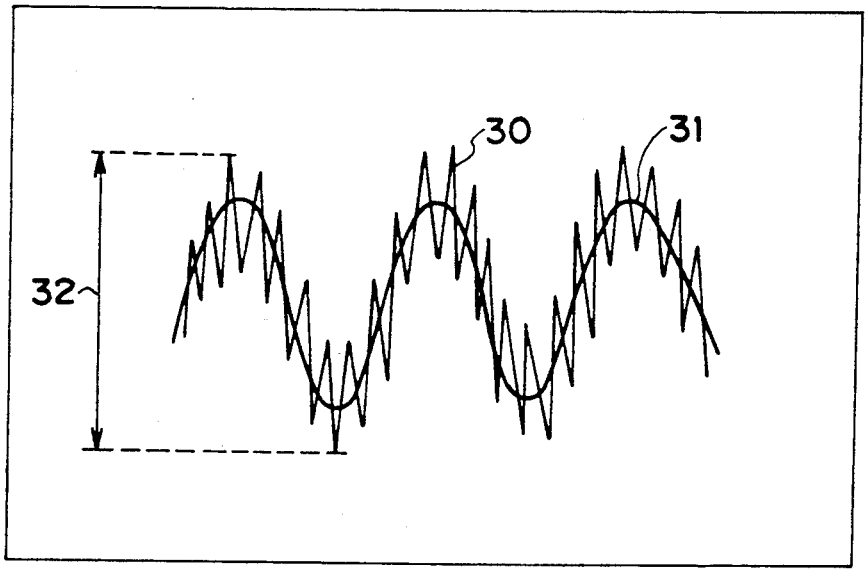

The magnetic field generator of the present invention is of a linearly shifting magnetic field type. A magnetic flux shifts from the narrow side of a mold toward an immersion nozzle in a direction crossing at a right angles to the direction of withdrawal a slab. Alternatively the magnetic flux shifts from the narrow side of the mold toward the immersion nozzle at a certain angle to the direction crossing at a right angle the direction of withdrawal of the slab. That is to say, the magnetic flux is applied in an adverse direction against the stream of the molten steel poured from the immersion nozzle. Accordingly, a density of the magnetic flux at a certain point inside the mold varies periodically. Therefore, the stream of the molten steel poured from the immersion nozzle does not always cross a magnetic flux having a constant density in terms of time. There occurs a difference in the total amount of electromagnetic forces received by the stream of the molten steel until the molten steel has passed through an area to which the linearly shifting magnetic field is introduced, depending on a difference in moments when the molten steel is poured from the immersion nozzle.

The present inventors have found the following:

Firstly, a period of time, necessary for a certain fragment of the stream of the molten steel poured from the immersion nozzle to pass through an area to which the linearly shifting magnetic field is introduced, is determined by a width of the mold, an amount of the molten steel poured from the immersion nozzle, an angle of discharge of molten steel from the immersion nozzle, a depth of exit ports of the immersion nozzle immersed into the molten steel and a frequency of electric current in the magnetic field generator. The amount of the molten steel is determined by the width of the mold and a casting speed.

Secondly, times of crossings of magnetic fluxes with stream of molten steel while the stream of the molten steel poured from the mold are passing through an area to which a linearly shifting magnetic field is introduced, are determined by a width of a mold, an average amount of molten steel poured from the immersion nozzle which is determined by the width of the mold and a casting speed, an angle of the molten steel poured from the immersion nozzle, a depth of exit ports of the immersion nozzle immersed into the molten steel and a frequency of electric current in the magnetic field generator.

Thirdly, flow velocity of the molten steel stream at the exit of said shifting magnetic field is reduced by the braking effect of electromagnetic forces obtained from the interaction with said shifting magnetic flux. It is possible to keep uniform the velocity over all fragments of the molten steel stream, if every fragment of the molten steel stream receives almost the same amount of electromagnetic force in the magnetic field.

Variation of the flow velocity and the increase of wave motion in the molten steel surface take place, when a fragment of the molten steel stream does not receive a same amount of, or receives a lesser amount of, electromagnetic force in the magnetic field.

In order to make sure that any fragment of the molten steel stream has the same amount of accumulated electromagnetic force in the magnetic field, the stream has to receive a minimum one cycle of, and preferably plural cycles of, the shifting magnetic flux in the magnetic field. Two methods are conceivable for accomplishing this.

A first method is a method wherein molten steel poured from the immersion nozzle passes, through the area, to which the linearly shifting magnetic field is introduced with a passing time which is as long as possible. A speed of the stream of the molten steel poured from the immersion nozzle is decreased by decreasing a casting speed. Alternatively, the stream of the molten steel poured from the immersion nozzle is caused to flow in a direction parallel to the direction of shift of the magnetic flux in the area to which the linearly shifting magnetic field is introduced, by making smaller an angle of the molten steel poured from the immersion nozzle with regard to a horizontal line. However, when the casting speed is decreased, the production efficiency of a continuous casting machine is lowered. When the angle of the molten steel poured from the immersion nozzle is decreased, mold powder in the stream of the molten steel is entangled, which gives rise to the entanglement of inclusions in a slab. Therefore, this first method is not advantageous.

The second method is a method wherein the frequency of electric current of the magnetic field generator is selected and a shifting speed of magnetic fluxes of the linearly shifting magnetic field is controlled. The frequency of electric current is set at a necessary minimum frequency or more so that any of the fragments of the stream of the molten steel can cross the moving magnetic flux at least once while the fragment of the molten steel poured from the immersion nozzle is passing through the area to which the linearly shifting magnetic field is introduced. That is to say, since any of the fragments of molten steel poured from the immersion nozzle undergoes at least once a braking force of the density of the magnetic flux of one cycle of the linearly shifting magnetic field during its passing through the area to which the linearly shifting magnetic field is introduced, there occurs no unevenness of degree of the introduction of the magnetic field to the molten steel, i.e., there is no unbalance wherein some parts of the molten steel are braked while others are not. If the selected frequency is a necessary minimum frequency or a frequency determined by multiplying the minimum frequency by an integer, any of the fragments of molten steel undergo the braking force equally, and the wave of the molten steel surface in the mold is further decreased.

According to this second method, since there is no direct influence on the casting speed and the angle of the molten steel poured from the immersion nozzle, the wave of the molten steel on surface can be decreased. However, when the frequency of electric current in the magnetic field generator is increased, the magnetic permeability is lowered, which lowers the density of the magnetic flux acting effectively on the stream of the molten steel poured from the immersion nozzle. Accordingly, this frequency is desired to be the minimum necessary frequency found by using the method described below or the frequency produced by multiplying the minimum frequency by an integer. For example, the frequency multiplied by an integer becomes a frequency multiplied by two or three. Since the braking force with which the shifting magnetic field acts on the fragments of the molten steel poured from the immersion nozzle increases in proportion to the product of the square of the magnetic flux and the frequency, it is effective to select a frequency multiplied by an integer which maximizes the product.

The minimum frequency of electric current necessary in the second method is found as follows:

An interval of time P [sec] at which the magnetic flux is shifted, passes periodically in the magnetic field generator, and is represented by the formula (1):

$$P=1/(N\cdot F) \quad (1)$$

where N is a number of poles in the magnetic field generator and F is a frequency of electric current in the magnetic field generator [Hz].

Figure 3:
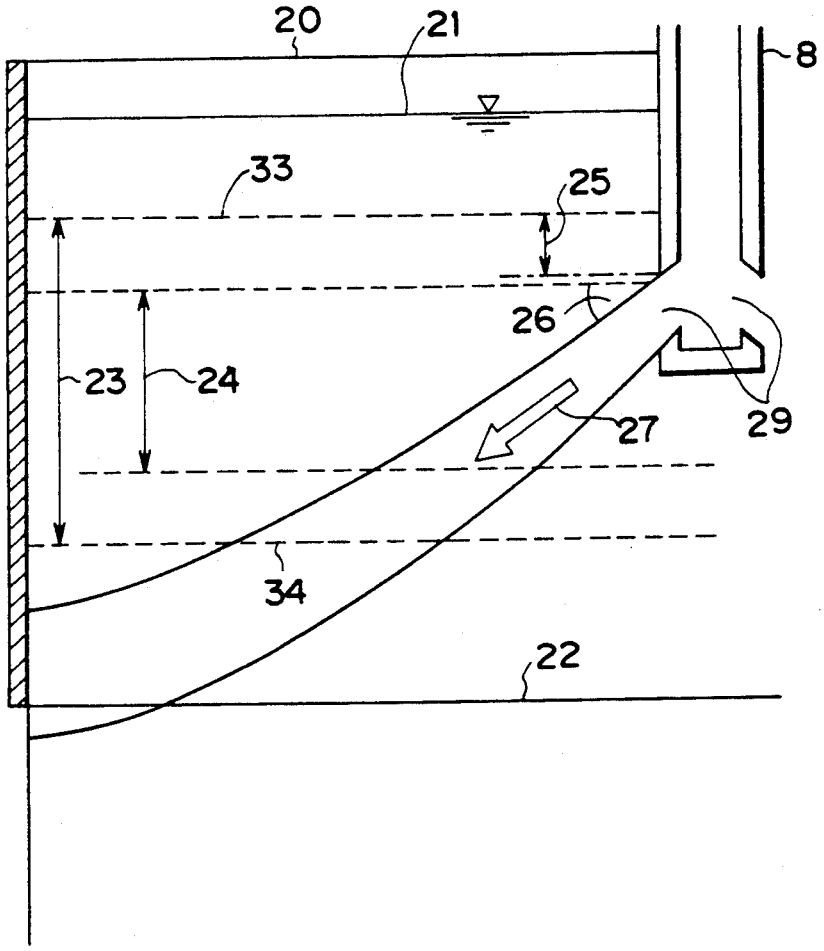
FIG. 3 is a schematic illustration showing a stream of the molten steel poured into the mold from an immersion nozzle of the present invention.

FIG. 3 is a schematic illustration showing a stream of molten steel poured from the immersion nozzle of the present invention. As shown in FIG. 3, the molten steel poured from the exit ports 29 of the immersion nozzle enters the area to which the linearly shifting magnetic field is introduced, reaches the lower end 34 of the area, and exits the area. The period of time from the entry of the molten steel into the area to the exiting of the molten steel from the area, that is, an effective braking period of time T[sec.] is represented by the formula (2).

$$T=(W-D)/(V\cdot\sin\theta) \quad (2)$$

where

V is an average speed of the stream of the molten steel [m/sec.] at which the stream of the molten steel poured from the immersion nozzle passes through the area. The area to which the linearly shifting magnetic field is introduced is an area which has a density of the magnetic flux of ½ of the maximum value as an average value of the magnetic flux per hour, which is measured at the center of the mold in the direction of the thickness of the mold;

$\theta$ is an angle[rad] formed by the stream of the molten steel poured from the exit ports of the immersion nozzle relative to a horizontal line when the stream of the molten steel passes through the area to which the linearly shifting magnetic field is introduced;

W is a width[m] of the area to which the linearly shifting magnetic field is introduced in the direction of the height of the mold; and D is a distance[m] from the upper end of the exit port of the immersion nozzle to the upper end of the area to which the linearly shifting magnetic field is introduced, when the end of the exit port of the immersion nozzle is located in the area to which the linearly shifting magnetic field is introduced, D being equal to 0 [m] when the end of the exit port of the immersion nozzle is out of the introduced area.

On the other hand, when a downwardly directed angle $\alpha$ of the exit port of the immersion nozzle is small or an angle formed by the direction of the stream of the molten steel poured from the immersion nozzle and the direction of the shifting of the magnetyic flux is small, the stream reaches a solid shell adjacent to the narrow sides of the mold before the stream of the molten steel goes out of the upper limit or the lower limit of the linearly shifting magnetic field. The time which the stream of the molten steel takes from existing the exit port of the immersion nozzle to arrival at the solid shell adjacent to the narrow side of the mold is an effective braking time T[sec.]. The time is represented by the following formula(3):

$$T=A/(2\cdot V\cos\theta) \quad (3)$$

where A is a width of cast slab.

It is very difficult to actually measure the values of V and $\theta$ in an operation of a continuous casting machine. Therefore, the present inventors reproduced an actual casting by using a water model to measure V and $\theta$. However, a braking effect by the magnetic field generator was not added to the values of V and $\theta$.

From the formulae (1) (2) and (3), by making P=T, there is determined a minimum frequency necessary to achieve uniformity of the total amount of magnetic fluxes which any of the fragments of molten steel poured from the immersion nozzle crosses during its passing through the area to which the linearly shifting magnetic field is introduced.

The minimum frequency of electric current is represented by the following formula (4) in a case where the stream of the molten steel poured from immersion nozzle goes out of the lower limit of the linearly shifting magnetic field:

$$F=(V\cdot\sin\theta)/\{N\cdot(W-D)\} \quad (4)$$

The minimum frequency of electric current is represented by the following formula (5) in a case where the stream of the molten steel poured from immersion nozzle is in the range of between the lower limit and the upper limit of the linearly shifting magnetic field:

$$F=(2\cdot V\cdot\cos\theta)/(N\cdot A) \quad (5)$$

In FIG. 3, symbols in the formula (4) and (5) are explained. Molten steel is poured into a mold from exit ports 29 of immersion nozzle 8. The molten steel poured from the exit ports of the immersion nozzle 8 passes through an area to which a linearly shifting magnetic field is introduced at an average flow speed 27 (V) and at an angle 26 ($\theta$) to the horizontal line. Reference numeral 24 denotes a width of a magnetic field generator in the direction of a height of a coil.

A width 23 (W) of the linearly shifting magnetic field in the direction of a height of the mold in the area to which the linearly shifting magnetic field is introduced is in between the upper end 33 and the lower end 34 of the introduced area. In the case where the upper end of the exit port of the immersion nozzle is located in the area to which the linearly shifting magnetic field is introduced, the shifting magnetic field does not act effectively on the stream of the molten steel in the area of a distance 25 (D) from the upper end of the exit port of the immersion nozzle to the lower end 34 of the area to which the linearly shifting magnetic field is introduced. The molten steel poured into the mold having the upper end 20 and the lower end 22 has a molten steel surface 21.

Figure 4:
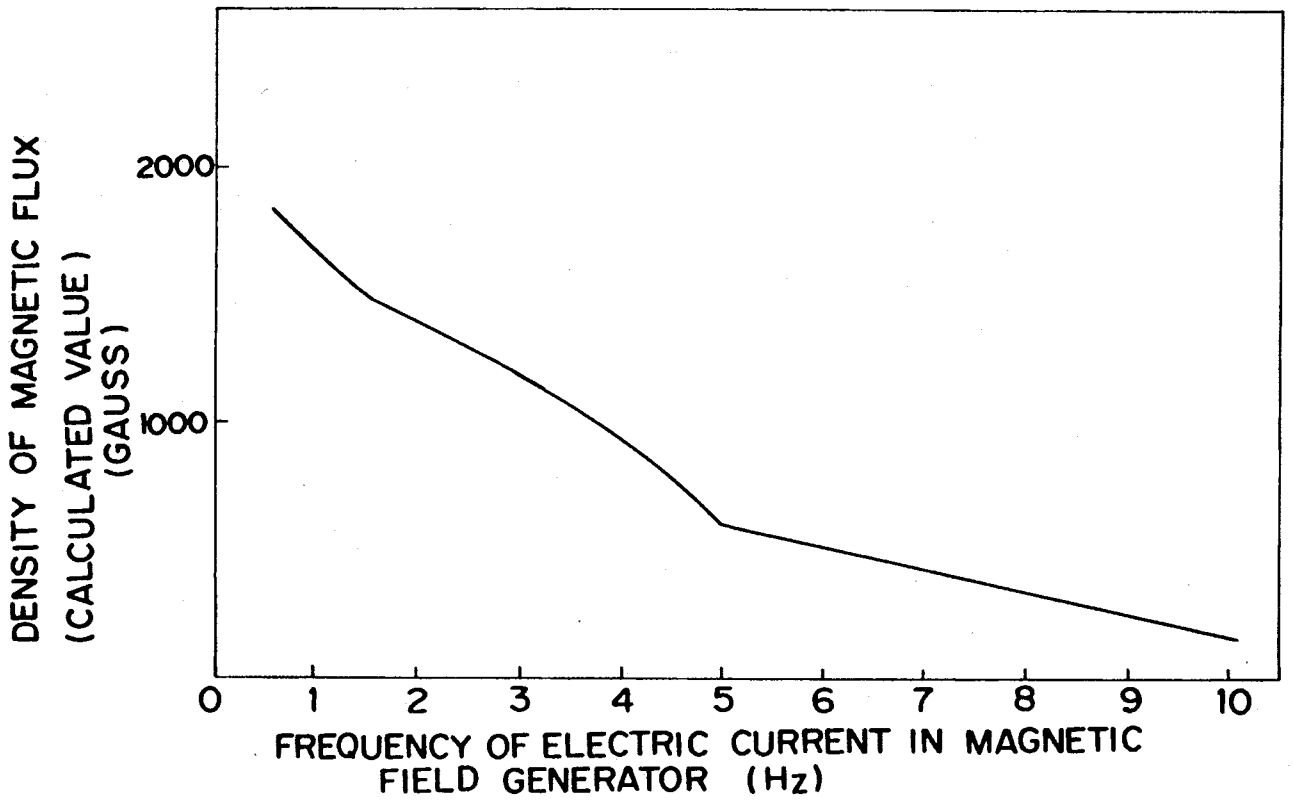
FIG. 4 is a graphical representation showing the relationship between frequency of an electric current in the magnetic field generator and an average maximum value of the magnetic fluxes per hour, which is obtained by calculation.

FIG. 4 is a graphical representation showing the relationship between the frequency of electric current in the magnetic field generator and the maximum value of average magnetic fluxes per hour in the mold, which was measured in a continuous casting machine. When the frequency of electric current is increased, a magnetic permeability of stainless steel plate and copper plate composing a frame of the mold is lowered, which lowers the densities of the magnetic fluxes. The densities of the magnetic fluxes in the mold of continuous casting machines are not always equal to those in FIG. 4 because of differences of structures and performances of individual apparatuses. According to the test conducted by the present inventors, in order to effectively brake a flow speed of the molten steel poured from an immersion nozzle, it is desirable that densities of magnetic fluxes in the mold be at least 1200 gauss. In the case of FIG. 4, a frequency of electric current of 2.8 Hz or less is selected, and the shifting speed of the linearly shifting magnetic filed is controlled.

However, since the values of the average flow speed of the molten steel and the angle $\theta$ cannot be measured in an actual operation of a continuous casting, there is inconvenience in that a necessary minimum frequency or a frequency which is calculated by multiplying the minimum frequency by an integer are not immediately obtained. The present inventors have found a way of solving the inconvenience.

The results of the test conducted by the above-mentioned water model was compared with those conducted by a continuous casting machine, using an effective braking parameter E. The effective braking parameter E is calculated according to a width A[m] of a mold for continuous casting, a thickness B[m] of casting, a casting speed C[m/sec.] and an effective area S[$m^2$] of the exit port of the immersion nozzle.

The test by the continuous casting was carried out under the following conditions:

a width of the slab cast was 0.7 to 2.6 m; the thickness of the slab cast was 0.1 to 0.3 m; the casting speed was 0.6 to 5.0 m/min.; the angle of poured molten steel from an immersion nozzle ranged from 60° directed downwardly to 15° directed upwardly; and the capacity of continuous casting machine per strand was 15 ton/min.

The water model test was carried out corresponding to the conditions of the above test by continuous casting.

Figure 13:
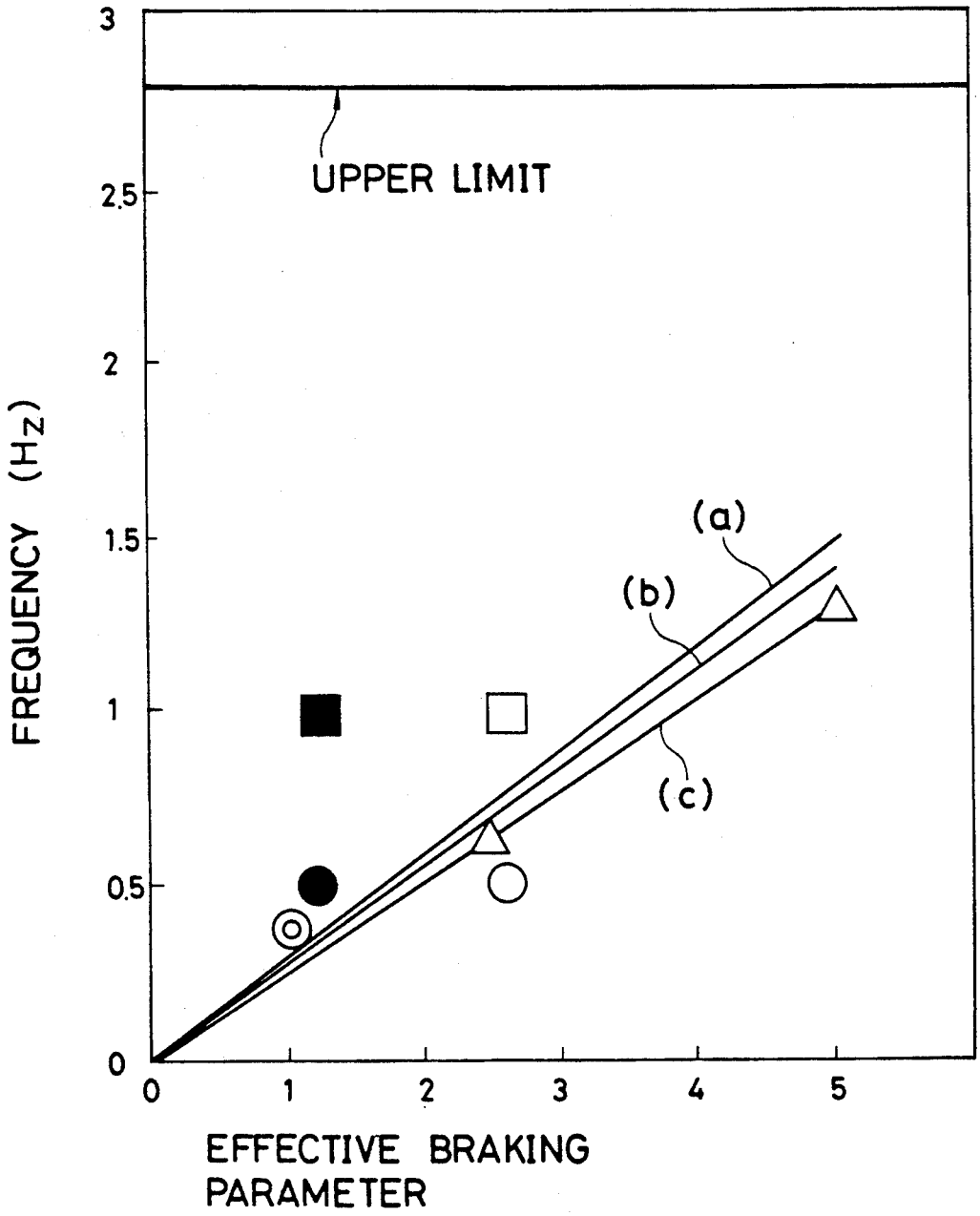
FIG. 13 is a graphical representation representing the lower limit of a frequency of electric current for depressing the wave of the molten steel surface with an effective braking parameter and an angle of the axis of the exit port of the immersion nozzle in the direction of poured molten steel.

Using the effective braking parameter E and the angle α of the molten steel poured from the exit port of the immersion nozzle, the minimum frequency F of electric current necessary for controlling the wave of the molten steel in the mold is represented as seen in FIG. 13. In FIG. 13, α is an angle formed by an axis of the exit port of the immersion nozzle and a horizontal line. The frequency calculated by multiplying the minimum frequency by an integer is represented shown as in FIG. 14.

An effective braking parameter E is determined responsive to the angle α formed by an axis of the exit port of the immersion nozzle and the horizontal line. The parameter E is represented by the following formula (6) in the case where the angle α is within the range of 60° to 25° directed downwardly:

$$E=(A\cdot B\cdot C)/\{N\cdot(W-D)\cdot S\} \quad (6)$$

The parameter E is represented by the following formula (7) in the case where the angle α is within the range of over 25° directed downwardly and below 15° directed upwardly:

$$E=4\cdot B\cdot C(\cos\alpha)^2/\{N\cdot A\cdot S\} \quad (7)$$

The formulas (6) and (7) are calculated according to a width A[m] of a mold for continuous casting, a thickness B[m] of casting, a casting speed C[m/sec.] and an effective area S[$m^2$] of the exit port of the immersion nozzle. The area S [$m^2$] is a section area crossing perpendicularly to the axis of the exit port of the immersion nozzle and the shape of the section area can be such as a circle, an elipse, a square, a rectangle and an egg-shape.

In FIG. 13, each of the straight lines is drawn corresponding to the respective angles α the exit port. Straight line(a) shows a case of the angle α being in the range from 60° to 35° both directed downwardly, straight line(b) a case of the angle α being in the range from over 35° to 25° directed downwardly, and straight line(c) a case of the angle α being in the range from over 25° directed downwardly and 15° inclusive, directed upwardly. The straight line(a) connects points (E=0, F=0) and (E=5, F=1.5), the straight line(b) points (E=0, F=0) and (E=5, F=1.4) and the straight line(c) points (E=0, F=0) and (E=5, F=1.3).

EXAMPLE

An example of the present invention will now be described with specific reference to the appended drawings.

Figure 5:
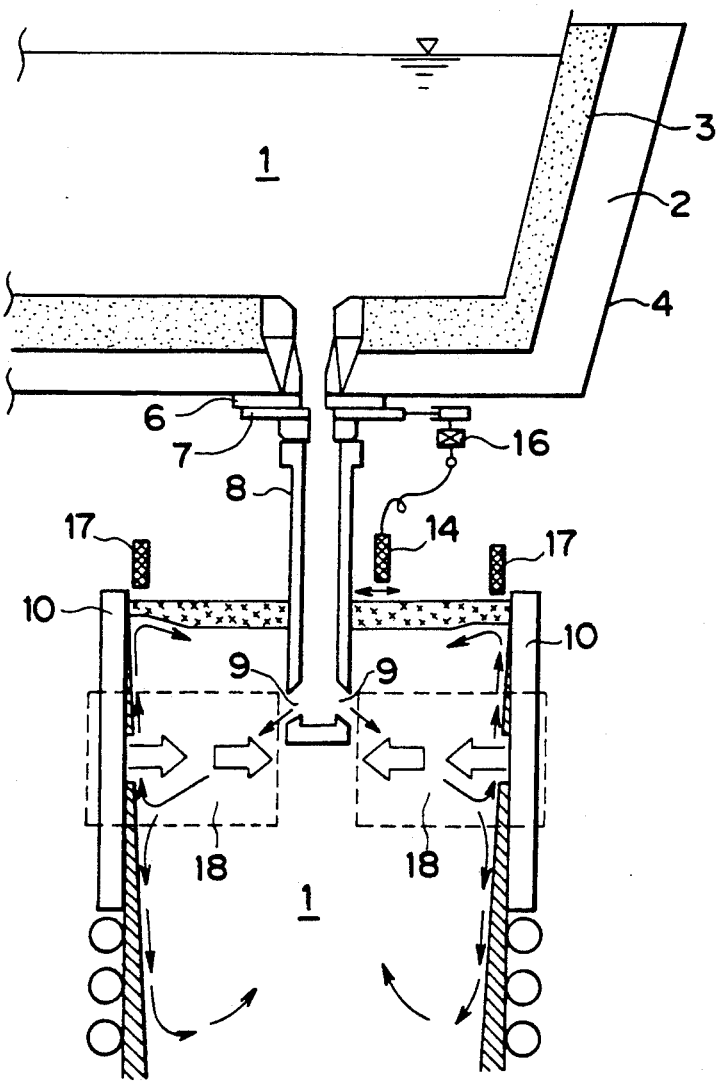
FIG. 5 is a vertical sectional view illustrating an apparatus for controlling a molten steel surface used in the method for continuous casting of the present invention.

FIG. 5 is a vertical sectional view illustrating a molten steel surface controller used in the method for continuous casting of steel of the present invention. A tundish 2 is mounted above a mold 10 for continuous casting, and molten steel is fed from a ladle (not shown) to the tundish 2. A inside wall of the tundish is lined with refractory 3, and an outside of the tundish is covered with a steel shell 4. A sliding nozzle 5 is placed at a bottom of the tundish 2. The sliding nozzle 5 has an immovable plate 6 fixed to the steel shell 4 and a sliding plate 7 sliding relative to the immovable plate 6. The nozzle 5 is opened and closed by sliding the sliding plate 7.

An immersion nozzle 8 is fixed to the lower side face of the sliding plate 7. A lower end portion of the immersion nozzle 8 is immersed in a molten steel 1 already poured into the mold 10. The molten steel 1 is poured into the mold 10 through a pair of exit ports 9 placed symetrically on both left and right sides thereof. A molten steel surface sensor 14 is arranged facing the surface of molten steel in the mold to detect positions of the molten steel surface and changes of the positions of the molten steel surface. The molten steel surface sensor 14 is connected to an input side of a monitor in a control device 16 for controlling a sliding nozzle opening angle. Independently from the molten steel surface sensor 14, two molten steel surface sensors 17 are positioned on the narrow sides of the mold, each of the sensors being on each of the both narrow sides of the mold. This molten steel surface sensor 17 is not connected to the control device 16. The molten steel surface sensor 17 monitors the effect of depressing the movement of the wave of the molten steel surface generated by the magnetic field generator of the present invention. The magnetic field generator 18 is placed behind copper plates of both wide sides of the mold.

Table 1 shows a composition of steel provided for the casting of the Examples of the present invention.

Table 2 shows operation conditions of the casting of the Examples of the present invention.

Table 3 shows a specification of the magnetic field generator used in the casting of the Example of the present invention.

TABLE 1

| Composition | C | Si | Mn | S | P | Soluble Al |
|---|---|---|---|---|---|---|
| Range (wt. %) | 0.03~0.08 | 0.04 or less | 0.10~0.25 | 0.025 or less | 0.25 or less | 0.030~0.070 |

TABLE 2

| | |
|---|---|
| Width of Mold | 1550 mm; 950 mm |
| Thickness of Cast Slab | 230 mm |
| Casting Speed | 2.0 m/min.; 1.6 m/min. |
| Flow Rate of Ar gas Blown into Immersion Nozzle | 10.0 N l/min |
| Immersion Nozzle | Inside Diameter: 90 mm; Exit Port: Square-Shaped; and Angle of Exit Port: 45° directed downwardly |
| Temperature of Molten Steel in Tundish | 1545~1565° C. |
| Immersion Depth of Exit Port of Immersion Nozzle | 270 mm above Molten Steel Surface (Position of Upper End Limit of Immersion Nozzle) |

TABLE 3

| | |
|---|---|
| Magnetic Field Capacity | Linearly Shifting Magnetic Field 2000KVA/strand (Three-phase Alternating Current) |

TABLE 3-continued

| | |
|---|---|
| Voltage | Max. 430 V/strand |
| Electric Current | Max. 2700 A/strand |
| Frequency of Electric Current | 0~2.6 Hz |
| Number of Poles | 2 |
| Maximum Density of Magnetic Flux B | 0.2 Tesra |
| W | 0.48 m |

The maximum density B of the magnetic flux shown in Table 3 is an average density of magnetic flux per hour at a point where an average density of magnetic flux per hour, which is measured at the center of the mold in the direction of the thickness thereof, shows a maximum value. W in Table 3 is a width of an area in the direction of the height of the mold, which has an average density of magnetic flux per hour of ½ of the maximum value of the density of magnetic flux with a position as the center, which shows the maximum value of the average density of magnetic flux per hour, and which is measured at the center of the mold in the direction of the thickness thereof.

Figure 6:
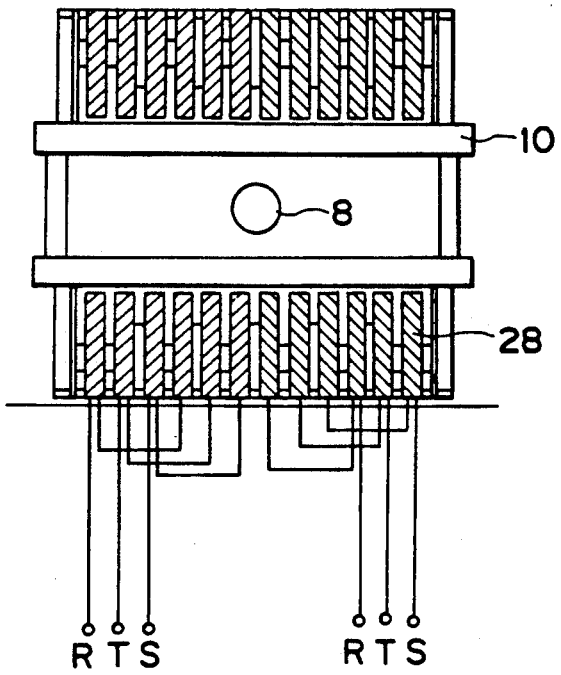
FIG. 6 is a wiring diagram showing a coil of the magnetic field generator seen from the upper side of the mold.

FIG. 6 is a wiring diagram showing a coil in the magnetic field generator used in the present invention.

EXAMPLE-1

Continuous casting of a slab was carried out by controlling the surface of molten steel in the mold by the magnetic field generator as shown in Table 3. The casting conditions are as shown in Table 2.

Firstly, an average flow V of the molten steel and an angle $\theta$ under the casting conditions as shown in Table 2 were measured in a water model test wherein a model of a mold scaled down to ⅓ of an actual mold was used. Measured values were converted in calculation to those of a scale of an actual apparatus operation. The values of $V=1.15$ m/sec and $\theta=0.70$ were obtained. A period of time [sec] necessary for a minute stream of the molten steel poured from the immersion nozzle to enter an area to which a linearly shifting magnetic field is introduced, and to exit the introduced area is calculated by substituting the said values of V and $\theta$ for the formula(3), and the time $T=0.56$(sec.) is obtained.

Accordingly, to effectively depress a wave of the molten steel surface when a casting speed is comparatively large and a width of a mold is large, a time period P[sec.] for which the magnetic fluxes pass periodically through the area, to which a linearly shifting magnetic field is introduced, is determined at 0.56 sec. or less. A frequency F of electric current in the magnetic field generator when the time period P[sec.] is determined to be 0.56 sec. or less is calculated by the formula(3) to be 0.89 (Hz) or more.

By using the above-mentioned results an operation of continuous casting wherein the casting speed was comparatively large and the width of the mold was large was carried out by depressing the wave of the molten steel surface. The results of the operation are shown in FIGS. 7.

Figure 7:
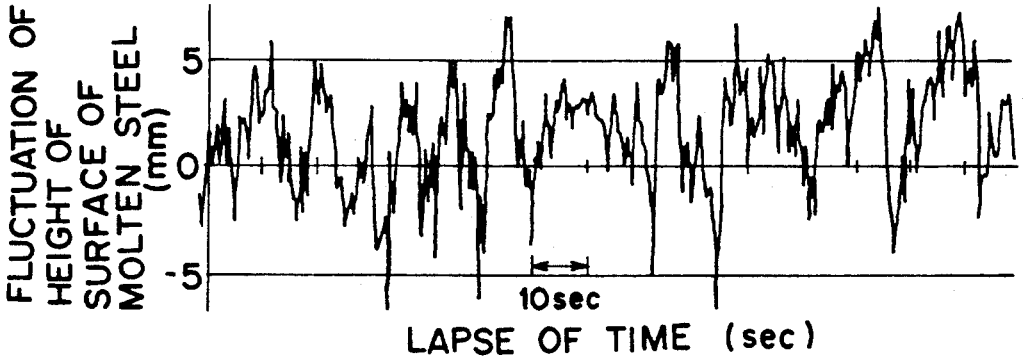
FIG. 7 is a graphical representation showing the results of an operation of continuous casting which depresses a wave of the molten steel surface adjacent to the narrow side of the mold, the operation being carried out under the condition of a large width of the mold and a comparatively large casting speed of molten steel.

The abscissa in FIG. 7 represents time. The time lapses from the right to the left on the graph. The ordinate represents height of the molten steel surface adjacent to the narrow side of the mold which is measured by the molten steel surface sensor 17. The operation conditions for the results in FIG. 7 is listed in Table 2. FIG. 7 shows the results of comparison in the case where the magnetic field generator was not used. Since the magnetic field generator was not used, the surface molten steel adjacent to the narrow side of the mold was greatly fluctuated. To depress this fluctuation of the surface molten steel, the magnetic field generator is driven.

Figure 8:
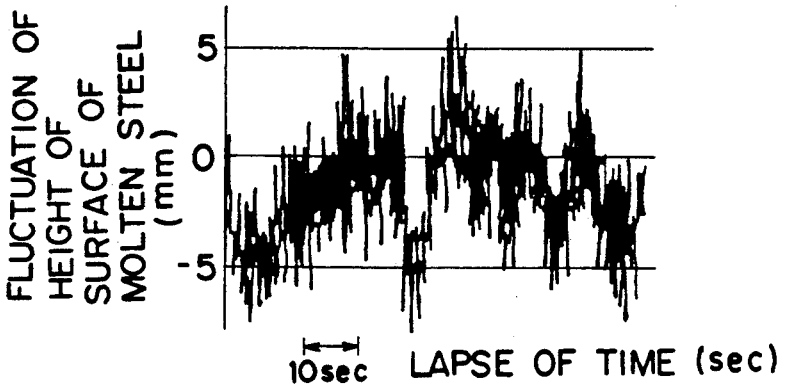
FIG. 8 is a graphical representation showing the results of an operation of continuous casting which depresses a wave of the molten steel surface adjacent to the narrow side of the mold, the operation being carried out under the condition of a large width of the mold and a comparatively large casting speed of molten steel.

FIG. 8 shows comparison wherein the magnetic field generator was driven with a frequency of electric current of 0.5 Hz and with a value of electric current of 1080 A. The frequency of electric current of 0.5 Hz is lower than the lower limit of the frequency of electric current of 0.89 Hz which effectively depresses the wave of the molten steel surface in the mold the casting speed is comparatively large and the width of the mold is large. That is, the necessary condition for the lower limit of the frequency of electric current under the operation condition as shown in Table 2 is not satisfied. Actually, as shown in FIG. 8, there is substantially no effect of depressing the wave of the molten steel surface adjacent to the narrow side of the mold. On the contrary, the wave of the molten steel surface is accelerated.

Figure 9:
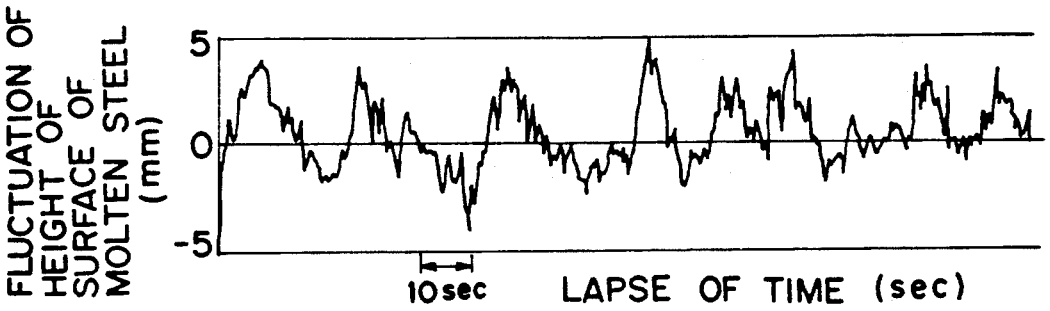
FIG. 9 is a graphical representation showing the results of an operation of continuous casting which depresses wave of the molten steel surface adjacent to the narrow side of the mold, the operation being carried out under the condition of a large width of the mold and a comparatively large casting speed of molten steel.

FIG. 9 shows an example wherein the magnetic field generator is driven with a frequency of electric current of 1.0 Hz and with the value of 1080 A. The frequency of electric current of 1.0 Hz is higher than the lower limit of the frequency of electric current of 0.89 Hz, which effectively depresses the wave of the molten steel surface when that the casting speed is comparatively large and the width of the mold is large. That is, the necessary condition for the lower limit of the frequency of electric current under the operation condition as shown in Table 2 is satisfied. It is well understood that the effect of depressing the wave of the molten steel surface adjacent to the narrow side of the mold is actually great as shown in FIG. 9.

Figure 10:
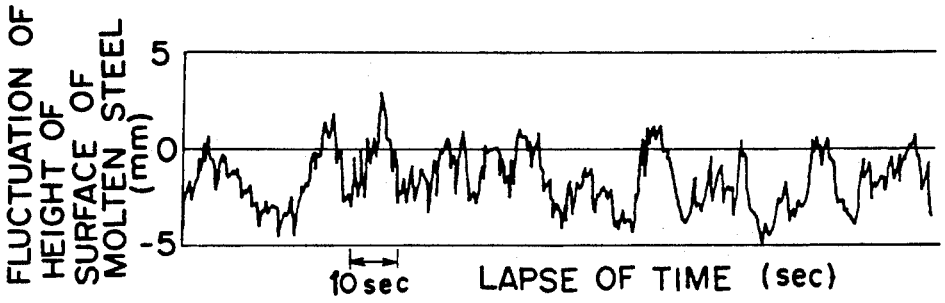
FIG. 10 is a graphical representation showing the results of an operation of continuous casting which depresses a wave the molten steel surface adjacent to the narrow side of the mold, the operation being carried out under the condition of a large width of the mold and a comparatively large casting speed of molten steel.

FIG. 10 shows an example wherein the magnetic field generator was driven with a frequency of electric current of 2.0 Hz and with a value of electric current of 1080 A. The frequency of electric current of 2.0 Hz is higher than the lower limit of the frequency of electric current of 0.89 Hz which effectively depresses the wave of the molten steel surface when the casting speed is comparatively large and the width of the mold is large. That is, the necessary condition for the lower limit of the frequency of electric current under the operation condition as shown in Table 2 is satisfied. It is also well understood that the effect of depressing the wave of the molten steel surface adjacent to the narrow side of the mold is actually great as shown in FIG. 10.

Figure 11:
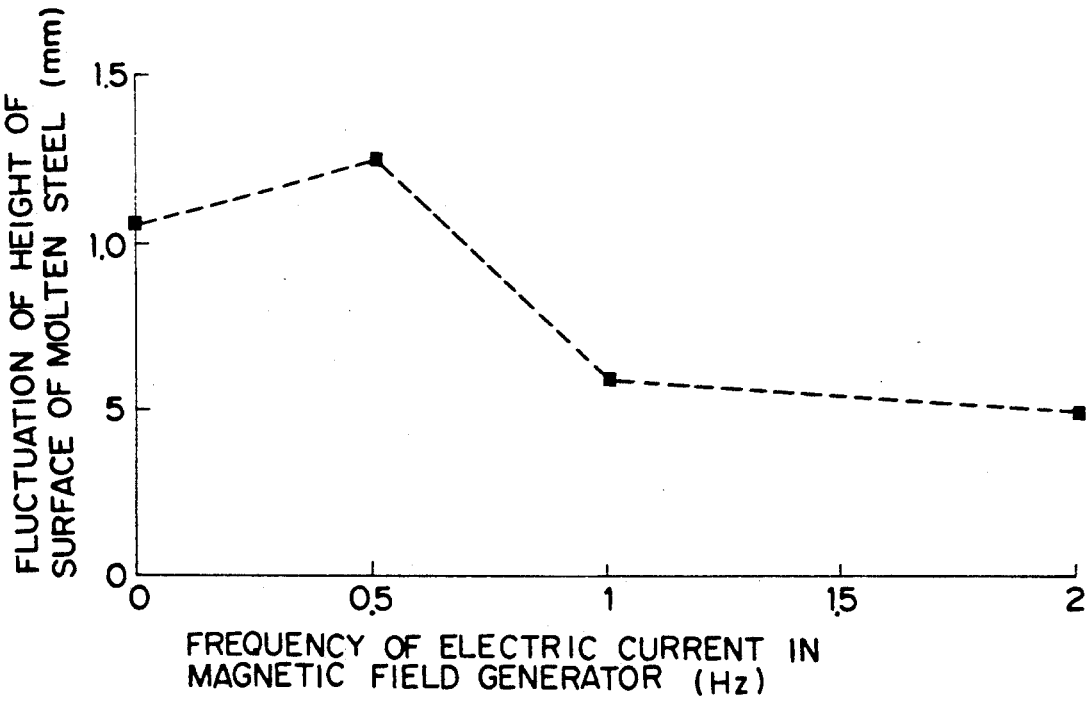
FIG. 11 is a graphical representation showing the results of FIGS. 7 to 10, the frequency of electric current being represented by the abscissa and the wave adjacent to the narrow side of the mold by the ordinate.

FIG. 11 shows the relationship of the wave of the molten steel surface adjacent to the narrow side of the mold to the frequency of electric current, which is obtained by summing up the results as shown in FIGS. 7 to 10. The abscissa represents the frequency of electric current and the ordinate the wave of the molten steel surface. The wave of the molten steel surface is sufficiently depressed by use of a frequency higher than the lower limit of the frequency of electric current of 0.89 Hz for effectively depressing the wave of the molten steel surface.

EXAMPLE 2

Figure 12:
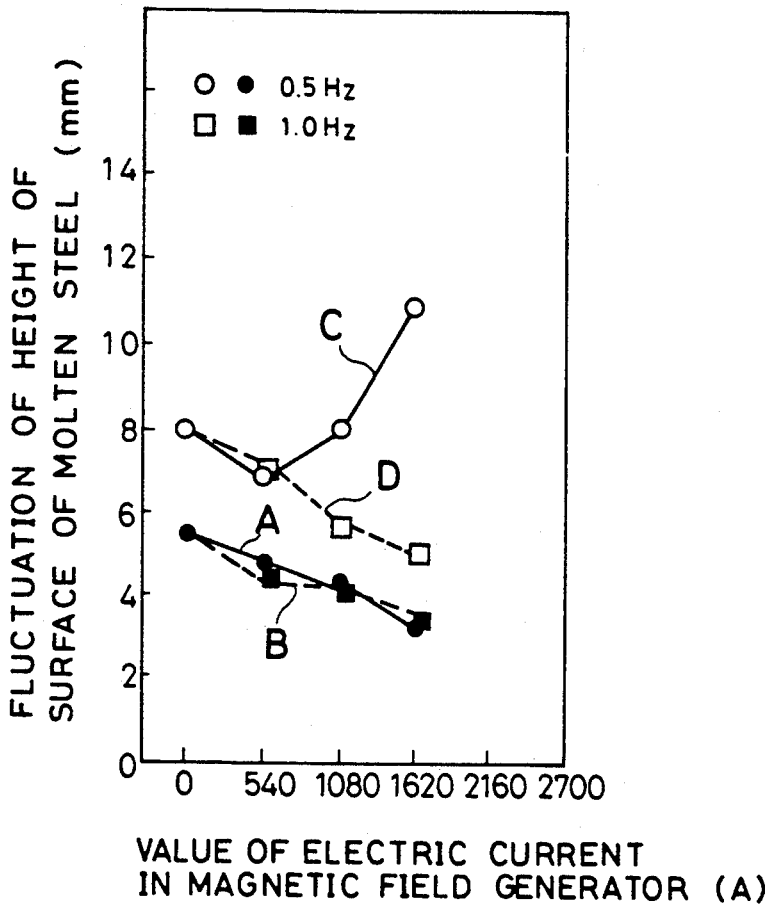
FIG. 12 is a graphical representation showing a change of the effect of depressing the wave of the molten steel surface adjacent to the narrow side of the mold when the value of electric current in the magnetic field generator is varied.

FIG. 12 shows the relationship between the value of electric current in the magnetic field generator and the magnitude of the wave of the molten steel surface adjacent to the narrow side of the mold. The casting conditions are those shown in Table 2. Lines A, B, C and D in FIG. 12 were carried out under the following conditions:

For lines A and B, a width of a mold was 950 mm. An immersion nozzle had square openings directed downwardly at 45° to the horizontal line. A casting speed was 1.6 m/min. In line A, a frequency of electric current was 0.5 Hz. In line B, a frequency of electric current was 1.0 Hz. In lines C and D, a width of a mold was 1550 mm. An immersion nozzle had square openings directed downwardly at 45° to the horizontal line. A casting speed was 2.0 m/min. In line C, a frequency of electric current was 0.5 Hz. In line D, a frequency of electric current was 1.0 Hz.

In FIG. 12, lines A and B show the case where a casting speed was comparatively small and a width of a mold was small. When the frequencies of electric current were 0.5 Hz and 1.0 Hz, the effect of depressing the wave of the molten steel surface adjacent to the narrow side of the mold was obtained in correspondence with each of the values of electric current. V was 0.67 m/sec, $\theta$ was 0.43 rad, and W was 0.48 under the casting conditions of A and B. The lower limit of the frequency of electric current found by the formula (3) was 0.43 Hz. Since the magnetic field was generated by the lower limit of the frequency of electric current of 0.43 Hz or more, the effect of depressing the wave of the molten steel surface was sufficiently produced. An effective braking parameter E was 1.2.

In FIG. 12, lines C and D show the case where the casting speed is comparatively large and the width of the mold is large. Under the casting conditions of the lines C and D, V is 1.15 m/sec, $\theta$ 0.66 rad, and W 0.48 m. The lower limit of the frequency of electric current is 0.89 Hz. The effective braking parameter is 2.6. The case of the line C is the case where the frequency of electric current is 0.5 Hz, which is lower than the lower limit of the frequency of electric current F of 0.89. In this case, when the value of electric current was increased, the wave of the molten steel surface is accelerated. The case of the line D is a case where the frequency of electric current is 1.0 Hz, which is higher than the lower limit of the frequency of electric current F of 0.89. The effect of depressing the wave of the molten steel surface is obtained in correspondence with each of the values of electric current.

A lower limit of a frequency of electric current for depressing wave of the molten steel surface in the mold is shown in FIG. 13. In the case of FIG. 13, casting conditions such as a width of casting, a thickness of slab cast, a casting speed, sorts of immersion nozzles and the like are varied in a wide range. A frequency of electric current is represented with the ordinate. A casting condition is represented with an effective braking parameter E of the abscissa and an angle $\alpha$ formed by an axis of an exit port of an immersion nozzle in the direction of the molten steel poured and the horizontal line.

In case that the stream of the molten steel poured from the exit port of the immersion nozzle goes out of the lower limit of the linearly shifting magnetic field, i.e., the angle $\alpha$ is in the range of 60° to 35° directed downwardly, the effective braking parameter E is represented by the formula $E=(A\cdot B\cdot C)/\{N\cdot(W-D)\cdot S\}$. In case that the stream of the molten steel poured from the exit port of the immersion nozzle is in the range of the upper limit and the lower limit of the linearly shifting magnetic field, i.e., the angle $\alpha$ is in the range of over 25° directed downwardly and below 15° inclusive, directed upwardly, the effective braking parameter E is represented by the formula $E=4\cdot B\cdot C(\cos\alpha)^2/\{N\cdot A\cdot S\}$. In FIG. 13, the straight line(a) represents a case where the angle $\alpha$ is in the range of from 60° to 35° directed downwardly, the straight line(b) a case where the angle $\alpha$ is in the range of over 35° to 25° directed downwardly, and a case where the angle $\alpha$ is in the range of over 25° directed downwardly and below 15° inclusive, directed upwardly.

When the effective braking parameter E has a comparative small value of from 1 to 2, a width of a mold is comparatively small or a casting speed is small. When E has a value of from 1 to 2, the lower limit of a frequency of electric current which depresses the wave of the molten steel surface is 0.8 Hz or less. The value of the effective braking parameter is increased as the width of the mold is or as the casting speed is increased. The lower limit of the frequency of electric current for depressing the wave of the molten steel surface shows a straight line rising right-wardly with an increase of the value of the effective braking parameter. However, the upper limit of the frequency of electric current allowing the magnetic permeability to be lower is constant irrespective of the width of the mold and the casting speed.

An example of the casting as shown in FIG. 12 is shown in FIG. 13. Symbols ●, ■, ○ and □ correspond to those of ●, ■, ○ and □ shown in FIG. 12.

Symbol ○ of FIG. 12 represents a case where the width of casting is 1550 mm, the casting speed is 2.0 m/min, and the angle of the axis of an exit port of an immersion nozzle relative to the horizontal line is 45° directed downwardly, but a point of symbol ○ in FIG. 13 is located below a straight line of the lower limit of the frequency of electric current shown by the angle $\alpha$ of 45°. In line C represented with symbol ○ in FIG. 12, the wave of the molten steel surface is accelerated when the value of electric current is increased. This is because there have been produced some portion of the stream of the molten steel poured from the immersion nozzle which have undergone an electromagnetic braking force and other portion thereof which have not. The wave of the molten steel surface has thus been increased.

Symbol ■ represents a case where the width of casting is 950 mm, the casting speed is 1.6 m/min, the angle of the axis of an exit port of an immersion nozzle relative to the horizontal line is 45° directed downward, and the lower limit of the frequency of electric current 0.43 Hz. The frequency of electric current was 1.0 Hz, which is substantially two times larger than the lower limit of the frequency of electric current. Since the magnetic field is generated with a frequency of electric current greater than the lower limit of the frequency of electric current of 0.43, the effect of braking the wave of the molten steel surface is sufficiently produced.

In FIG. 13, a case is shown where the stream of the molten steel poured from the exit port of the immersion nozzle has not yet gone out of the range of the upper limit and the lower limit, i.e. the angle $\alpha$ of the exit port of the immersion nozzle is in the range of over 25° directed downwardly and below 15° inclusive, directed upwardly. Symbol ⊙ shown in FIG. 13 is a case where the width of casting is 2100 mm, the thickness of a slab cast is 250 mm, the casting speed is 2.0 m/min., and the angle $\alpha$ of the exit port of the immersion nozzle is 15° directed downward. The effective braking parameter E is 1.1, the frequency of electric current of lower limit 0.40 Hz. Even the frequency of electric current being of the standard level of the lower limit of 0.40 Hz is effective in depressing the wave of the molten steel surface. Since this is in the range where the product of the square of the magnetic flux and the frequency of electric current is expected to be increased even if the frequency of the electric current is further increased, the casting has been carried out by the frequency of 1.2 which is 3 times as large as the frequency of electric current of the lower limit. By this 1.2 Hz, the wave of the molten steel surface has been more effectively depressed. Symbol Δ shown in FIG. 13 is a case where the width of casting is 700 mm, the thickness of a slab cast 250 mm, the casting speed is 3.0 m/min. and 1.5 m/min., and the angle α the exit port of the immersion nozzle 5° directed downward. The effective braking parameter E is 5.0 and 2.5, the frequency of electric current of lower limit 1.30 Hz and 0.65 Hz. In the case where the casting speed is 3.0 m/min., the frequency of electric current is doubled to be 2.60 Hz, and in the case where the casting speed is 3.0 m/min. the frequency of electric current is doubled to be 1.30 Hz. In both cases, the wave of the molten steel surface is effectively depressed.

Figure 14:
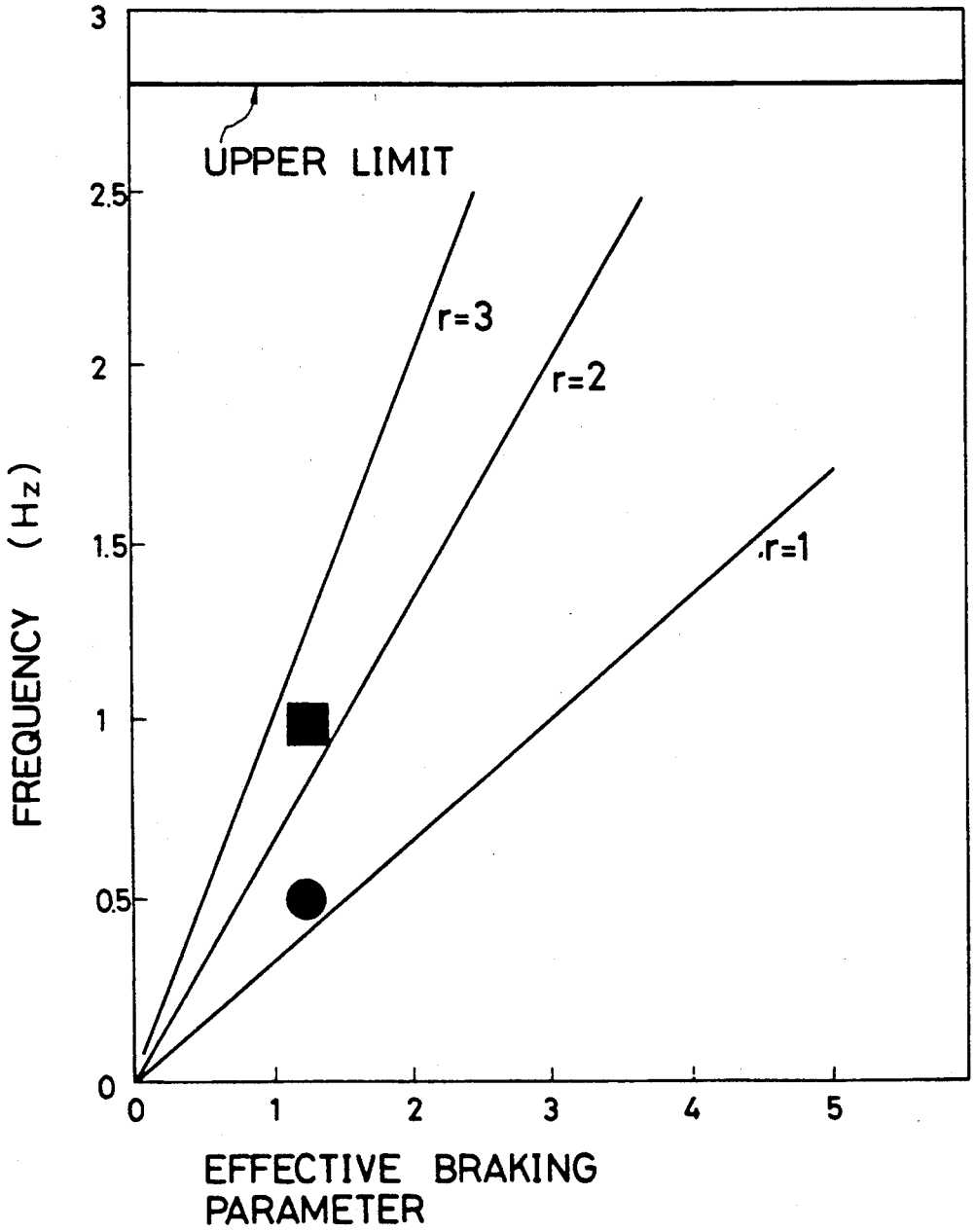
FIG. 14 is a graphical representation showing a straight line indicating a lower limit of a frequency of electric current for depressing the wave of the molten steel surface and a straight line indicating a frequency of electric current obtained by multiplying the above frequency by an integer.

In FIG. 14, a straight line showing the lower limit of the frequency of electric current and a straight line showing the frequency of electric current obtained by multiplying the lower limit of the frequency of electric current by an integer are represented when the angle α of the exit port of the immersion nozzle is in the range of 60° to 25° both directed downwardly. In FIG. 14, r=1 is for the standard frequency of electric current of the lower limit, r=2 is for two times of the standard frequency, and r=3 is for three times standard frequency.

In the case of symbol ■, a frequency substantially two times larger than the lower limit of the frequency of electric current is used. Since the stream of the molten steel poured from the immersion nozzle undergoes an electromagnetic braking force twice during its passing through the area to which the linearly shifting magnetic field is introduced, the wave of the molten steel surface is depressed to such an extent as satisfied. In this way, the selection of frequencies is not limited to the lower limit of the frequency of electric current. The lower limit of the frequency of electric current or more, or frequency two times or three times larger than the lower limit of the frequency of electric current can be used. However, unless the frequency of electric current is below the upper limit of the frequency of electric current allowing the permeability to be lowered, the effect of depressing the wave of the molten steel surface cannot be produced.

As described above, according to the present invention, a wave of a molten steel surface in a mold can be well depressed by driving the magnetic field generator within a range of frequencies of electric current, even when the casting speed is comparatively large and the width of the mold is large. In consequence, the entanglement of mold powder in the molten steel due to the wave of the molten steel surface is prevented. Moreover, since a violent disturbance of the molten steel, which is generated together with the wave of the molten steel surface, is prevented, mold powder entangled in molten steel and non-metallic inclusions in molten steel, which are generated in a process of refining, are not prevented from rising to the surface of molten steel in the mold, which facilitates the removal of those inclusions from the molten steel in the mold.

What is claimed is:

1. A method for continuous casting of a slab, comprising the steps of:

feeding molten steel into a mold through exit ports of an immersion nozzle, the mold having a pair of wide sides and a pair of narrow sides, and the immersion nozzle being positioned at the center of the mold from the pair of narrow sides;

controlling a stream of the molten steel by means of an electromagnetic stirrer having a linearly shifting magnetic field, a direction of the linearly shifting magnetic field being toward the immersion nozzle, and distributions of magnetic fluxes of the linearly shifting magnetic field being symmetrical relative to a center line of the immersion nozzle;

a first control step of controlling a frequency of a wave of the linearly shifting magnetic field to be higher than a threshold frequency, said wave having said threshold frequency having a period equal to the time during which the stream of the molten steel fed into the mold from the immersion nozzle passes through a field area to which the linearly shifting magnetic field is introduced, said field area having an upper limit and a lower limit; and a second control step of controlling the frequency of the wave of the linearly shifting magnetic field to be low enough such that the magnetic fluxes of the linearly shifting magnetic field are of a density high enough to apply a braking force to the molten steel.

2. The method of claim 1, wherein said first control step comprises controlling a frequency of an electric current for generating the linearly shifting magnetic field to be a value such that when the stream of the molten steel from the immersion nozzle falls outside the lower limit of said field area, the value is determined by the following formula:

$$F \geqq (V \cdot \sin\theta)/\{N \cdot (W-D)\}$$

where

F represents the value of frequency (Hz) of the electric current for generating the linearly shifting magnetic field;

v represents average stream speed (m/sec.) of the molten steel fed from the immersion nozzle when the stream of the molten steel passes through the field area;

θ represents an angle (rad) formed by the stream of the molten steel relative to a horizontal line when the stream of the molten steel passes through the field area;

W represents a width (m) of the field area in a direction of a height of the mold;

D represents a distance (m) from an upper end of the exit port of the immersion nozzle to an upper limit of the field area, when the upper end of the exit port of the immersion nozzle is located in the field area; and N represents a number of poles in the magnetic field generator.

3. The method of claim 1, wherein said first control step includes controlling a frequency of electric current for generating the linearly shifting magnetic field to be a value such that when the stream of the molten steel fed from the immersion nozzle falls within the upper limit and the lower limit of the field area, the value is determined by the following formula:

$$F \geqq (2 \cdot V \cdot \cos\theta)/(N \cdot A)$$

where

F represents the value of frequency (Hz) of electric current for generating the linearly shifting magnetic field;

v represents average stream speed (m/sec.) of the molten steel poured from the immersion nozzle when the stream of the molten steel passes through the field area;

$\theta$ represents an angle (rad) formed by the stream of the molten steel relative to a horizontal line when the stream of the molten steel passes through the field area;

A represents a width of a slab continuously cast; and

N represents a number of poles in the magnetic field generator.

4. The method of claim 1, wherein said first control step includes controlling a frequency of an electric current to be greater than or equal to a frequency F, the frequency F being determined by an effective braking parameter E and an angle $\alpha$, the angle $\alpha$ being formed by an axis of the exit port of the immersion nozzle in a direction of the fed molten steel relative to a line horizontal thereto and ranging from 60° to 25° directed downwardly, said effective braking parameter E being represented by the following formula:

$$E=(A\ B\ C)/\{N(W-D)S\}$$

where

A represents a width (m) of the mold for continuous casting of a slab;

B represents a thickness (m) of the slab continuously cast;

C represents a speed (m/sec.) of the continuous casting;

S represents an effective area ($m^2$) of the exit port of the immersion nozzle;

N represents a number of poles in the magnetic field generator;

W represents a width (m) of the field area in a direction of a height of the mold;

D represents a distance (m) from an upper end of the exit port of the immersion nozzle to an upper limit of the field area, when the upper end of the exit port of the immersion nozzle is located in the field area; and wherein said effective braking parameter E is represented by a straight line connecting the point (E=0, F=0) and the point (E=5, F=1.5) when the angle $\alpha$ ranges from 60° to 35° both directed downwardly, the abscissa representing the effective braking parameter E and the ordinate representing the frequency F of electric current.

5. The method of claim 1, wherein said first control step includes controlling a frequency of electric current for generating the linearly shifting magnetic field to be greater than or equal to a frequency F, the frequency F being determined by an effective braking parameter E and an angle $\alpha$, the angle $\alpha$ being formed by an axis of the exit port of the immersion nozzle in a direction of the fed molten steel relative to a line horizontal thereto and ranging over 25° directed downwardly and below 15° inclusive, directed upwardly, said effective braking parameter E being represented by the following formula:

$$E=4B\ C(\cos\alpha)^2/\{N\ A\ S\}$$

where

A represents a width (m) of the mold for continuous casting of a slab;

B represents a thickness (m) of the slab continuously cast;

C represents a speed (m/sec.) of the continuous casting;

S represents an effective area ($m^2$) of the exit port of the immersion nozzle; and N represents a number of poles in the magnetic field generator; and wherein said effective braking parameter E is represented by a straight line connecting the points (E=0, F=0) and (E=5, F=1.3) when the angle $\alpha$ ranges over 25° directed downwardly and below 15° inclusive, directed upwardly, the abscissa representing the effective braking parameter E and the ordinate representing the frequency F of electric current.

6. The method of claim 1, wherein said first control step includes controlling a frequency of electric current for generating the linearly shifting magnetic field to be greater than or equal to a frequency f, the frequency f being calculated by multiplying a frequency F of electric current by an integer, and the frequency F being determined by an effective braking parameter E and an angle $\alpha$, the angle $\alpha$ being formed by an axis of the exit port of the immersion nozzle in a direction of the fed molten steel relative to a line horizontal thereto and ranging from 60° to 35° directed downwardly, said effective braking parameter E being represented by the following formula:

$$E=(A\ B\ C)/\{N(W-D)S\}$$

where

A represents a width (m) of the mold for continuous casting of a slab;

B represents a thickness (m) of the slab continuously cast;

C represents a speed (m/sec.) of the continuous casting;

S represents an effective area ($m^2$) of the exit port of the immersion nozzle;

N represents a number of poles in the magnetic field generator;

W represents a width (m) of the field area in a direction of a height of the mold;

D represents a distance (m) from an upper end of the exit port of the immersion nozzle to an upper limit of the field area, when the upper end of the exit port of the immersion nozzle is located in the field area; and wherein said effective braking parameter E is represented by a straight line connecting the points (E=0, F=0) and (E=5, F=1.5) when the angle $\alpha$ ranges from 60° to 35° both directed upwardly, the abscissa representing the effective braking parameter E and the ordinate representing the frequency F of electric current.

7. The method of claim 1, wherein said first control step includes controlling a frequency of electric current for generating the linearly shifting magnetic field to be greater than or equal to frequency f, the frequency f being calculated by multiplying frequency F of electric current by an integer, and the frequency F being determined by an effective braking parameter E and an angle α, the angle α being formed by an axis of the exit port of the immersion nozzle in a direction of the fed molten steel relative to a line horizontal thereto and ranging over 25° directed downwardly and below 15° directed upwardly, said effective braking parameter E being represented by the following formula:

$$E=4\,B\,C(\cos\alpha)^2/\{N\,A\,S\}$$

where

A represents a width (m) of the mold for continuous casting of a slab;

B represents a thickness (m) of the slab continuously cast;

C represents a speed (m/sec.) of the continuous casting;

S represents an effective area ($m^2$) of the exit port of the immersion nozzle; and N represents a number of poles in the magnetic field generator; and wherein said effective braking parameter E is represented by a straight line connecting the points (E=0, F=0) and (E=5, F=1.3) when the angle α ranges over 25° directed downwardly and below 15° inclusive, directed upwardly, the abscissa representing the effective braking parameter E and the ordinate representing the frequency F of electric current.

8. The method of claim 1, wherein said second control step includes controlling a frequency of an electric current for generating the linearly shifting magnetic field so that the density of the magnetic fluxes in the mold is at least 1200 gausses.

9. The method of claim 8, wherein the frequency of said electric current is 2.8 Hz.

10. The method of claim 1, wherein said first control step includes controlling a frequency of an electric current to be greater than or equal to a frequency F, the frequency F being determined by an effective braking parameter E and an angle α, the angle α being formed by an axis of the exit port of the immersion nozzle in a direction of the fed molten steel relative to a line horizontal thereto and ranging from 35° to 25° directed downwardly, said effective braking parameter E being represented by the following formula:

$$E=(A\,B\,C)/\{N(W-D)S\}$$

where

A represents a width (m) of the mold for continuous casting of a slab;

B represents a thickness (m) of the slab continuously cast;

C represents a speed (m/sec.) of the continuous casting;

S represents an effective area ($m^2$) of the exit port of the immersion nozzle;

N represents a number of poles in the magnetic field generator;

W represents a width (m) of the field area in a direction of a height of the mold;

D represents a distance (m) from an upper end of the exit port of the immersion nozzle to an upper limit of the field area, when the upper end of the exit port of the immersion nozzle is located in the field area; and wherein said effective braking parameter E is represented by a straight line connecting the point (E=0, F=0) and the point (E=5, F=1.4) when the angle α ranges from 35° to 25° directed downwardly, the abscissa representing the effective braking parameter E and the ordinate representing electric current frequency.

11. The method of claim 1, wherein said first control step includes controlling a frequency of electric current for generating the linearly shifting magnetic field to be greater than or equal to a frequency f, the frequency f being calculated by multiplying a frequency F of electric current by an integer, and the frequency F being determined by an effective braking parameter E and an angle α, the angle α being formed by an axis of the exit port of the immersion nozzle in a direction of the fed molten steel relative to a line horizontal thereto and ranging from 60° to 35° directed downwardly, said effective braking parameter E being represented by the following formula:

$$E=(A\,B\,C)/\{N(W-D)S\}$$

where

A represents a width (m) of the mold for continuous casting of a slab;

B represents a thickness (m) of the slab continuously cast;

C represents a speed (m/sec.) of the continuous casting;

S represents an effective area ($m^2$) of the exit port of the immersion nozzle;

N represents a number of poles in the magnetic field generator;

W represents a width (m) of the field area in a direction of a height of the mold;

D represents a distance (m) from an upper end of the exit port of the immersion nozzle to an upper limit of the field area, when the upper end of the exit port of the immersion nozzle is located in the field area; and wherein said effective braking parameter E is represented by a straight line connecting the point (E=0, F=0) and the point (E=5, F=1.5) when the angle a ranges from 60° directed downwardly to 35° inclusive, directed upwardly, the abscissa representing the effective braking parameter E and the ordinate representing the frequency F of the electric current.

* * * * *

UNITED STATES PATENT AND TRADEMARK OFFICE

CERTIFICATE OF CORRECTION

PATENT NO. : 5,307,863

DATED : May 3, 1994

INVENTOR(S) : KUBOTA et al.

It is certified that error appears in the above-indentified patent and that said Letters Patent is hereby corrected as shown below:

Column 1, line 34, before "fulcrum" insert --a--.

Column 2, line 28,
change "wave of a the" to --a wave of the--.

Column 4, line 53, after "withdrawal" insert --of--;
line 56, after "angle" insert --to--.

Column 7, line 41, change "existing" to --exiting--.

Column 8, line 54, change "filed" to --field--.

Column 9, line 5, change "a" to --the--;
line 23, change "shown as" to --as shown--.

Column 11, line 59, change "F1GS." to --FIG.--;
line 65, change "is" to --are--;
line 66, after "of" insert --a--.

Column 12, line 11, after "mold" insert --when--.

UNITED STATES PATENT AND TRADEMARK OFFICE

CERTIFICATE OF CORRECTION

PATENT NO. :5,307,863

DATED :May 3, 1994

INVENTOR(S) :KUBOTA et al

It is certified that error appears in the above-indentified patent and that said Letters Patent is hereby corrected as shown below:

Column 14, line 16, after "is" (first occurrence) insert --increased--;
line 68, delete "being".

Column 15, line 13, after "nozzle", insert --is--;
line 31, delete "of the";
line 54, change "the" to --a--.

Column 20, line 54, change "a" to --α--.

Signed and Sealed this

Twenty-first Day of May, 1996

Bruce Lehman

BRUCE LEHMAN

*Commissioner of Patents and Trademarks*

*Attest:*

*Attesting Officer*